US008752239B2

(12) United States Patent
Conrad

(10) Patent No.: US 8,752,239 B2
(45) Date of Patent: Jun. 17, 2014

(54) VACUUM CLEANER WITH WHEELED BASE

(71) Applicant: G.B.D. Corp., Nassau (BS)

(72) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 0 days.

(21) Appl. No.: 13/720,754

(22) Filed: Dec. 19, 2012

(65) Prior Publication Data

US 2013/0104335 A1 May 2, 2013

Related U.S. Application Data

(62) Division of application No. 11/954,331, filed on Dec. 12, 2007, now Pat. No. 8,359,705.

(60) Provisional application No. 60/870,175, filed on Dec. 15, 2006, provisional application No. 60/884,767, filed on Jan. 12, 2007.

(51) Int. Cl.

| | |
|---|---|
| ***A47L 5/00*** | (2006.01) |
| ***A47L 5/36*** | (2006.01) |
| ***A47L 5/24*** | (2006.01) |

(52) U.S. Cl.

CPC ... *A47L 5/00* (2013.01); *A47L 5/36* (2013.01); *A47L 5/24* (2013.01)

USPC ..... 15/329; 15/353; 15/410

(58) Field of Classification Search

USPC ..... 15/329, 353, 410

See application file for complete search history.

(56) References Cited

U.S. PATENT DOCUMENTS

| | | | | |
|---|---|---|---|---|
| 3,320,727 | A | 5/1967 | Farley et al. | |
| 5,309,600 | A | 5/1994 | Weaver et al. | |
| 5,515,573 | A | 5/1996 | Frey | |
| 5,709,007 | A | 1/1998 | Chiang | |
| 5,815,881 | A | 10/1998 | Sjogreen | |
| 6,094,775 | A * | 8/2000 | Behmer | 15/329 |
| 6,295,692 | B1 * | 10/2001 | Shideler | 15/327.5 |
| 6,502,278 | B2 | 1/2003 | Oh et al. | |
| 6,536,072 | B2 * | 3/2003 | Paliobeis et al. | 15/323 |
| 7,128,770 | B2 | 10/2006 | Oh et al. | |
| 7,188,388 | B2 * | 3/2007 | Best et al. | 15/329 |
| 7,377,007 | B2 | 5/2008 | Best | |
| 7,426,768 | B2 | 9/2008 | Peterson et al. | |
| 7,485,164 | B2 | 2/2009 | Jeong et al. | |

FOREIGN PATENT DOCUMENTS

CA 2450450 A1 12/2004

* cited by examiner

*Primary Examiner* — Lee D Wilson
*Assistant Examiner* — Shantese McDonald
(74) *Attorney, Agent, or Firm* — Knobbe Martens Olson & Bear LLP

(57) ABSTRACT

A canister style surface cleaning apparatus comprises a wheeled based having a front end and a cleaning mount, the cleaning mount adapted to receive a surface cleaning attachment that comprises a first flexible hose; a portable cleaning unit removably mounted on the wheeled base and comprising a suction motor and at least one cyclonic separation stage having an associated material collection chamber which is sealed when the portable cleaning unit is removed from the wheeled base; and, a fluid flow path extending from the cleaning mount to a clean air exit of the surface cleaning apparatus.

15 Claims, 7 Drawing Sheets

VACUUM CLEANER WITH WHEELED BASE

CROSS-REFERENCES TO RELATED APPLICATIONS

This application claims benefit under 35 USC 120 as a divisional application of co-pending U.S. patent application Ser. No. 11/954,331, filed on Dec. 12, 2007, which itself claims priority from U.S. Provisional Patent applications 60/870,175 (filed on Dec. 15, 2006), and 60/884,767 (filed on Jan. 12, 2007), both of which are incorporated herein by reference in their entirety.

FIELD OF THE INVENTION

This application relates to surface cleaning apparatuses such as vacuum cleaners, wet/dry vacuum cleaner and carpet extractors that comprise a wheeled base. More specifically, this application relates to cyclonic surface cleaning apparatuses that are mounted to a wheeled base including one or more wheels and a cradle.

BACKGROUND OF THE INVENTION

Various types of surface cleaning apparatuses are known in the art. Such surface cleaning apparatuses include vacuum cleaners, including upright vacuum cleaners, hand-carryable vacuum cleaners, canister type vacuum cleaners, and shop-vac type vacuum cleaners. Some such vacuum cleaners are provided with wheels. For example, typical upright vacuum cleaners are provided with a surface cleaning head that includes wheels mounted to a bottom surface thereof. Upright vacuum cleaner are easy for a consumer to use since the consumer does not have to carry the vacuum cleaner but merely push it over a surface. However, depending on the size of the surface cleaning head, an upright vacuum cleaner may not be useable in smaller or crowded areas. Canister vacuum cleaners have a flexibly hose extending between a surface cleaning head and the canister body, thereby improving mobility of the cleaning head. However, consumers must separately move a canister body, which can add an extra step during the cleaning process.

SUMMARY OF THE INVENTION

In accordance with this invention, a surface cleaning apparatus, preferably a canister or shop-vac style vacuum cleaner is provided which comprises a portable cleaning unit and a wheeled base. Preferably, the cleaning unit is removably mounted to the wheeled base. Alternately, or in addition, the wheeled base has wheels mounted outward of the wheeled base, and which are preferably of a larger diameter (e.g., 1-3 inches in diameter, preferably 1.5-2.5 inches in diameter).

In one broad aspect, a surface cleaning apparatus is provided. The surface cleaning apparatus comprises a member having a dirty fluid inlet. A fluid flow path extends from the dirty fluid inlet to a clean air outlet of the surface cleaning apparatus. The surface cleaning apparatus further comprises a wheeled based. A portable cleaning unit is removably mounted on the wheeled base and comprising at least one cyclonic separation stage and a suction motor positioned in the fluid flow path.

Embodiments in accordance with this broad aspect may be advantageous because the surface cleaning apparatus may have increased maneuverability. That is, the surface cleaning apparatus may be used as a wheel mounted surface cleaning apparatus when convenient for a user since the user need not carry the surface cleaning apparatus, or as a hand or strap carryable surface cleaning apparatus, such as when a stairs or a smaller or crowded area is to be cleaned, according to the user's preference.

In some embodiments, the at least one cyclonic separation stage comprises a cyclone chamber having at least one material outlet, a divider plate associated with the material outlet and an associated material collection chamber in flow communication with the material outlet.

In some embodiments, the material collection chamber is positioned below the material outlet. In a further embodiment, the divider plate is positioned in the material outlet.

In some embodiments, the material collection chamber is moveable relative to the cyclone chamber. In a further embodiment the material collection chamber is removable from the at least one cyclone chamber.

In some embodiments, the material collection chamber has a portion that is openable. In a further embodiment, the portion that is openable is a bottom wall. Such embodiments may be advantageous because the wheeled base may prevent accidental opening of the material collection chamber.

In some embodiments, the suction motor is positioned laterally spaced from the at least one cyclonic separation stage. Accordingly, the surface cleaning apparatus may have a relatively wide stance and low centre of mass, and therefore may have increased stability.

In some embodiments, the cleaning unit has a front end having the dirty fluid inlet and the front end of the cleaning unit is positioned at a front end of the wheeled base and the suction motor is positioned rearward of the at least one cyclonic separation stage.

In some embodiments, the wheeled base has a length greater then its width. In further embodiments, the wheeled base is generally polygonal, and preferably generally triangular in shape. Such embodiments may be advantageous because the surface cleaning apparatus may have both increased maneuverability and increased stability.

In some embodiments, the wheeled base has at least one front wheel and at least two rear wheels, the rear wheels have a larger diameter then the at least one front wheel and the at least one front wheel is steerable. Such embodiments may be advantageous because the larger rear wheels may provide the wheeled base with increased stability, and the steerable front wheel may provide the wheeled base with increased maneuverability. Alternately, the front wheels may have a larger diameter or essentially the same diameter as the rear wheels.

In some embodiments, the wheeled base has at least one front wheel and at least two rear wheels and the rear wheels have a larger diameter then the at least one front wheel.

In some embodiments, the wheeled base has at least one front wheel and at least two rear wheels and the rear wheels have a smaller diameter then the at least one front wheel.

In some embodiments, the at least one front wheel is steerable.

In some embodiments, the wheeled base has rear wheels and the rear wheels are positioned outwardly of an area occupied by the cleaning unit when the cleaning unit is mounted on the wheeled base. Alternately, or in addition, the wheeled base has front wheels and the front wheels are positioned outwardly of an area occupied by the cleaning unit when the cleaning unit is mounted on the wheeled base Such embodiments may be advantageous because the wheeled base may have a relatively wide stance, thereby providing greater stability to the surface cleaning apparatus. Additionally, the surface cleaning apparatus may be relatively close to the ground, and may therefore have a lower centre of mass and increased stability.

In some embodiments, the cleaning unit has a front end having a fluid inlet downstream from the dirty fluid inlet and the front end of the cleaning unit is positioned at a front end of the wheeled base.

In some embodiments, the cleaning unit is lockably receivable on the wheeled base.

In some embodiments, the wheeled base has at least one front wheel having a diameter of 1 to 3 inches and at least two rear wheels having a diameter of 1 to 3 inches.

In some embodiments, the cleaning unit has a carry handle and/or a shoulder strap.

In some embodiments, the wheeled base has at least one front wheel and at least two rear wheels, and the cleaning unit is receivable on an open platform.

In some embodiments, the wheeled base has an absence of operating components.

In another broad aspect, a surface cleaning apparatus is provided. The surface cleaning apparatus comprises a member having a dirty fluid inlet. A fluid flow path extends from the dirty fluid inlet to a clean air outlet of the surface cleaning apparatus. A cleaning unit positioned in the fluid flow path and comprises at least one cyclonic separation stage and a suction motor. A wheeled base is mounted to the portable cleaning unit. The wheeled base comprises at least one front wheel and at least two rear wheels. The rear wheels are positioned outwardly of an area occupied by the cleaning unit when the wheeled base is mounted to the cleaning unit.

In some embodiments, the rear wheels have a larger diameter than the at least one front wheel.

In some embodiments, the rear wheels have a smaller diameter than the at least one front wheel.

BRIEF DESCRIPTION OF THE DRAWINGS

These and other advantages of the instant invention will be more fully and completely understood in conjunction with the following description of the preferred embodiments of the invention.

DETAILED DESCRIPTION OF THE INVENTION

Figure 1:
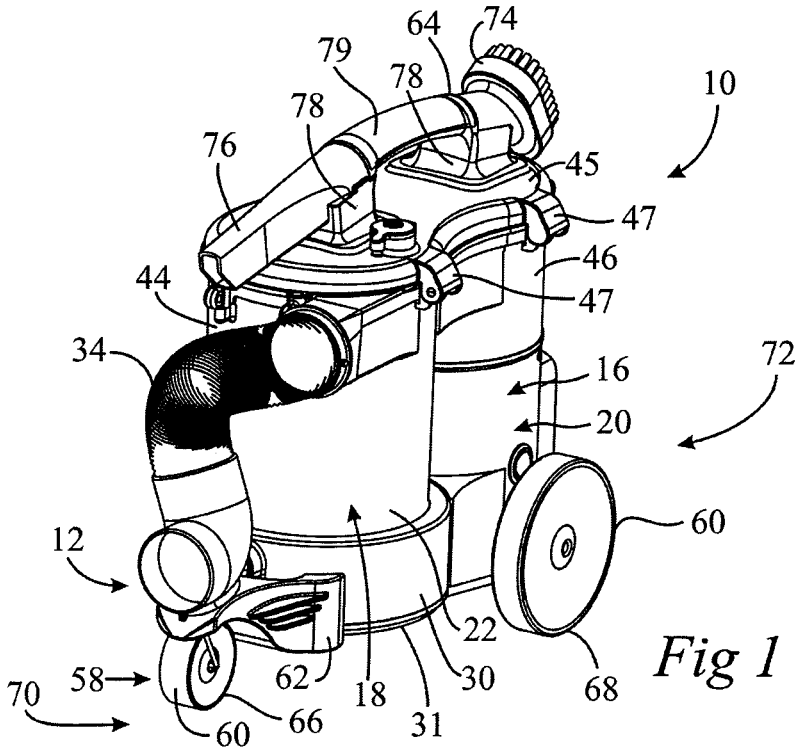
FIG. 1 is a perspective view of an embodiment of a surface cleaning apparatus of the present invention.
Figure 2:
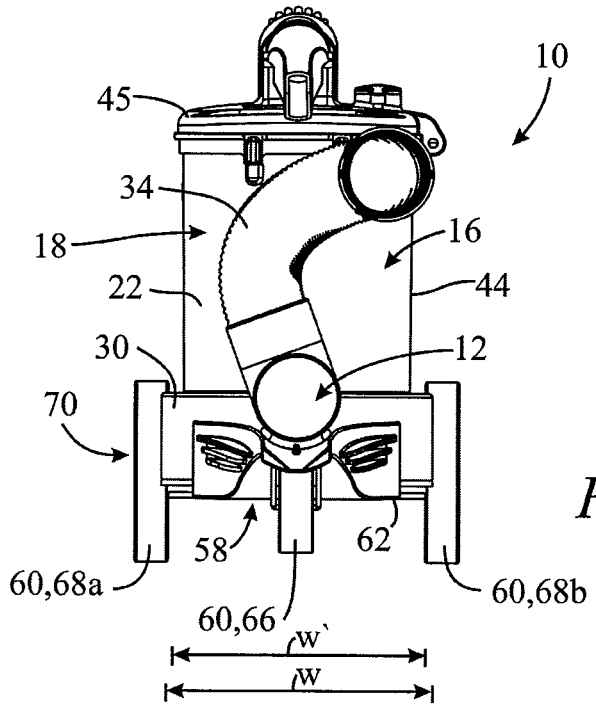
FIG. 2 is a front view of the embodiment of FIG. 1.
Figure 3:
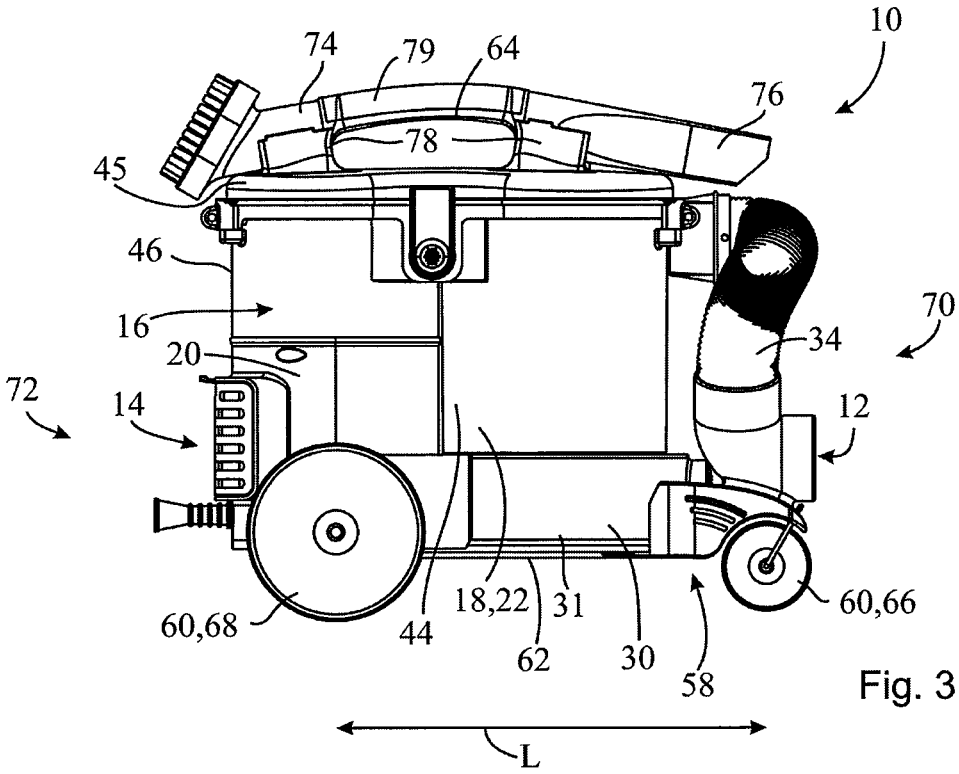
FIG. 3 is a side view of the embodiment of FIG. 1.
Figure 4:
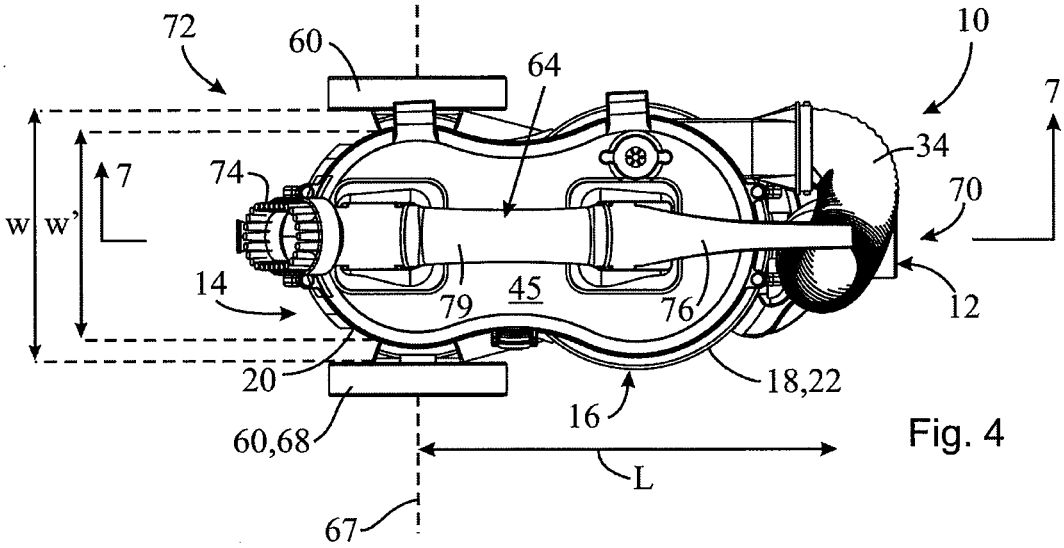
FIG. 4 is a top view of the embodiment of FIG. 1.

Referring to FIGS. 1-4, an embodiment of a surface cleaning apparatus 10 of the present invention is shown. Surface cleaning apparatus 10 may be a canister type vacuum cleaner, a shop-vac type vacuum cleaner, or another type of vacuum cleaner that may be mounted to a wheeled base. Surface cleaning apparatus 10 comprises a dirty fluid inlet 12, a clean air outlet 14, and a fluid flow path extending therebetween. A portable cleaning unit 16 is provided in the fluid flow path. Cleaning unit 16 comprises at least one cyclonic separation stage 18 for removing dirt from air, or for removing liquid from air or to pick up liquid. Cleaning unit 16 further comprises a suction motor 20 for drawing fluid from the dirty fluid inlet 12 to the clean air outlet 14.

Dirty fluid inlet 12 is provided in a member 34. In the embodiment shown in FIGS. 1-6, member 34 is a hose. In the embodiment shown in FIGS. 7-10, member 34 is a nozzle. In other embodiment, member 34 may be, for example, a surface cleaning head. It will be appreciated that a flexible hose, a rigid wand or other attachment may be affixed or removably affixed to portable cleaning unit 16.

Figure 7:
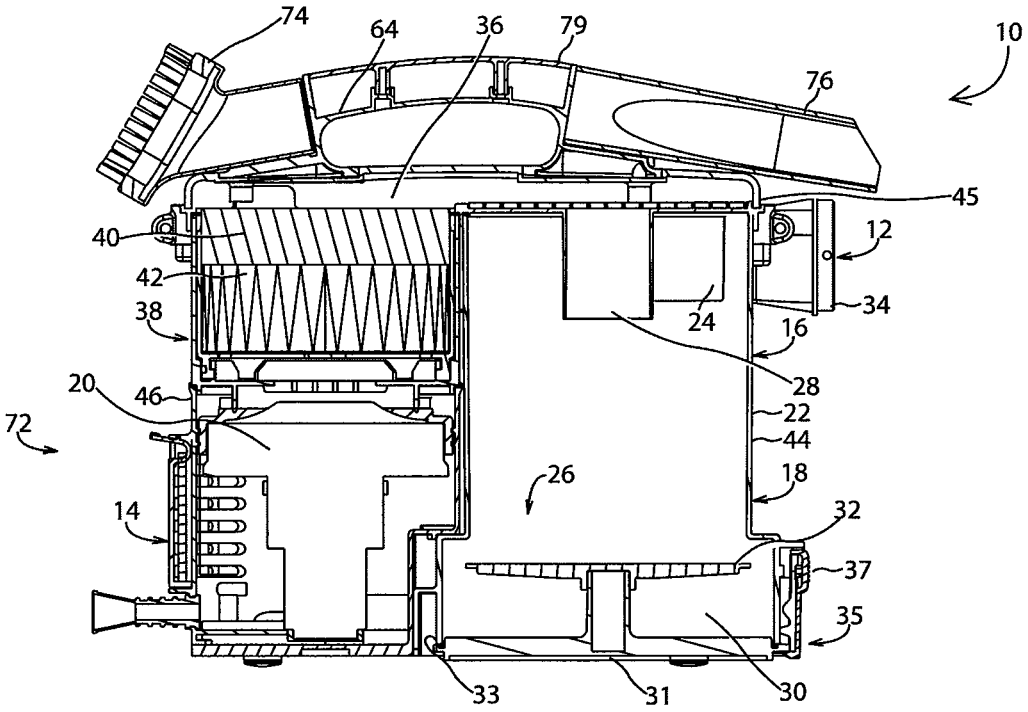
FIGS. 7-9 are cross-sections taken along line 7-7 in FIG. 1, showing alternate configurations of a cleaning unit.
Figure 8:
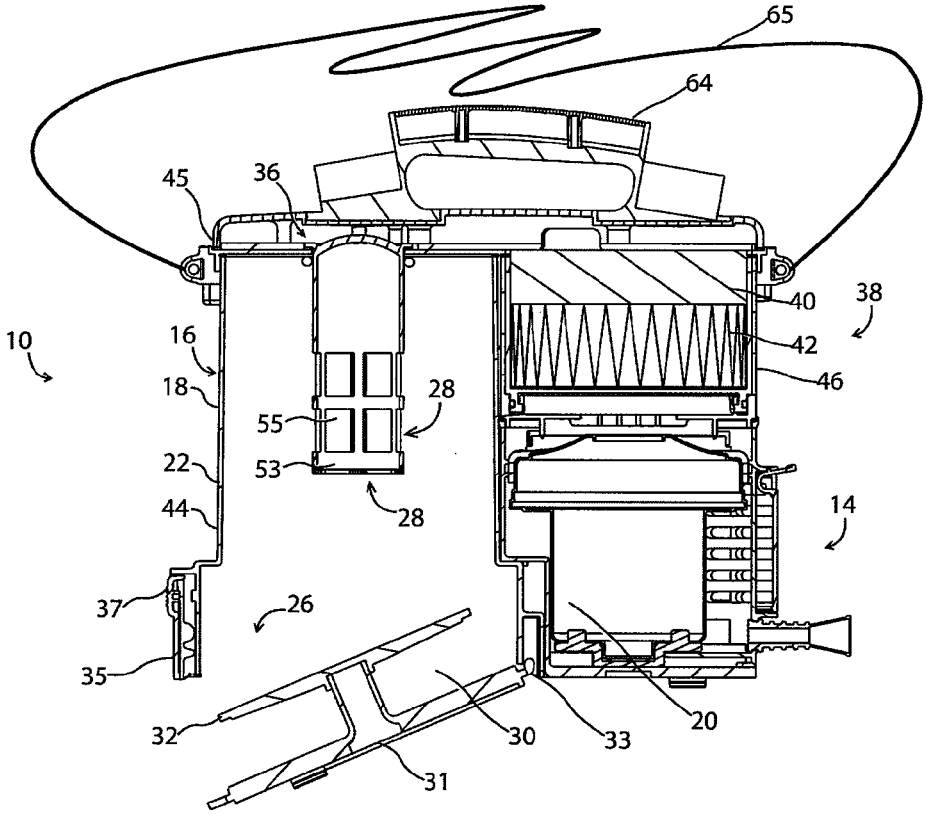
Figure 9:
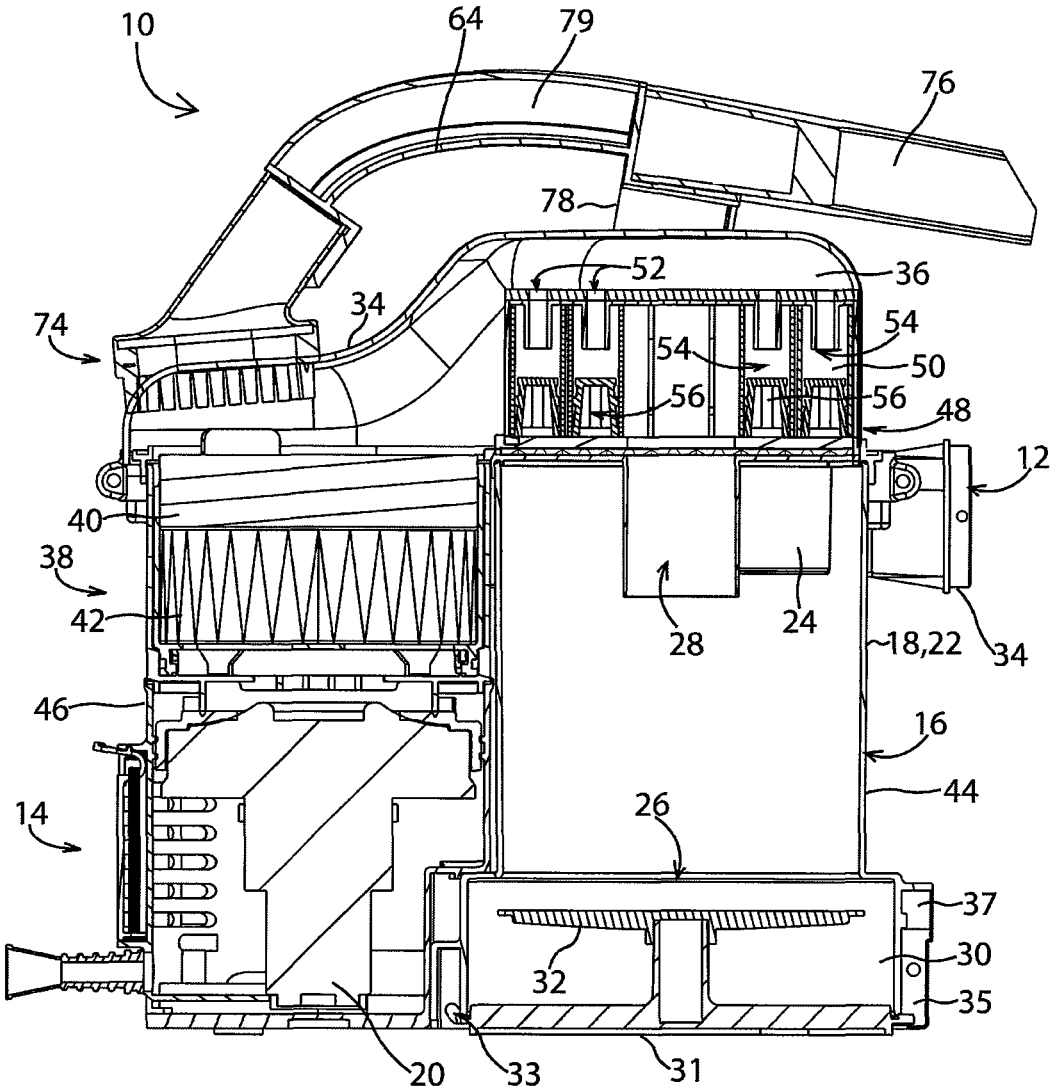

Referring to the exemplified embodiments of FIGS. 7-9, from dirty fluid inlet 12, fluid is directed to cleaning unit 16. Cleaning unit 16 may be of a variety of configurations. In the embodiment of FIGS. 7 and 8, cleaning unit 16 comprises a single cyclonic cleaning stage 18 preferably comprising a single cyclone housed in a first housing 44, and a filter assembly 38 and motor 20 housed in a second housing 46 adjacent the first housing. Accordingly, in this embodiment, the suction motor 20 is positioned laterally adjacent and laterally spaced from the cyclonic cleaning stage 18. In the embodiment of FIG. 9, cleaning unit 16 comprises first 18 and second 48 cleaning stages housed in first housing 44, and filter assembly 38 and motor 20 housed in second housing 46 laterally adjacent the first housing. In this embodiment, motor 20 is positioned laterally spaced from and laterally adjacent both of first 18 and second 48 cleaning stages. It will be appreciated that portable cleaning unit may utilize one or more cyclonic cleaning stages, each of which may comprise a single cyclone or a plurality of cyclones in parallel. In any embodiment, one or more additional cleaning stages may be used such as one or more filters.

For example, in the embodiments exemplified, cyclonic cleaning stage 18 includes a single cyclone chamber 22. Cyclone chamber 22 comprises a dirty air inlet 24, a separated or dirty material outlet 26, and a clean air outlet 28. A dirty or separated material collection chamber 30 is mounted below dirty material outlet 26, for collecting material removed from the air in cyclone chamber 22. In the embodiment shown, a divider plate 32 is associated with dirty material outlet 26. Divider plate 32 is positioned below the dirty material outlet 26, within the material collection chamber 30. It will be appreciated that a divider plate may be used any one or more of the cyclones and it may be of any configuration and located at any position known in the art. Alternately, a divider plate may not be used.

Material collection chamber 30 may be of any configuration and may be emptied by a user in any manner known in the art. In the embodiment shown in FIGS. 7 and 8, material collection chamber 30 has a bottom 31 that is openable by pivoting about a pivot pin 33. In this embodiment, material collection chamber further comprises a latch 35, for locking bottom 31 in place, and a button 37 for releasing the latch. In other embodiments, material collection chamber 30 may be emptied in another manner. For example, material collection chamber 30 may be movable or removable from surface cleaning apparatus 10, such that it may be emptied, or may have another portion that opens. It may be removable from portable cleaning unit with the associated cyclone or cyclones as a sealed unit.

In some embodiments, a filter or a screen may be associated with clean air outlet 28. For example, as shown in FIG. 8, a cylindrical housing 53 may be mounted on clean air outlet 28 and may have a plurality of openings 55 which are provided with a screen (e.g. a wire mesh). Any such screen or filter known in the art may be used.

In the embodiment of FIGS. 7 and 8, air is directed from cyclone chamber 22 out of clean air outlet 28, and into an airflow passage 36, which extends between first housing 44 and second housing 46. From airflow passage 36, air is directed through a filter assembly 38, which, in the embodiments exemplified, comprises a foam filter 40, and a screen filter 42. From filter assembly 38, air is drawn past motor 20, and out of clean air outlet 14.

In the exemplified embodiment of FIG. 9, from cyclone chamber 22, air is directed out of clean air outlet 28 and into second cyclonic cleaning stage 48. Second cyclonic cleaning stage 48 comprises a plurality of second stage cyclones 50 in parallel. Each second stage cyclone comprises an inlet (not shown) in fluid communication with clean air outlet 28, and an outlet 52 in fluid communication with airflow passage 36. Each second stage cyclone comprises a cyclonic cleaning region 54, and a dirt collection region 56. From outlets 28, air is directed into airflow passage 36, and into filter assembly 38. From filter assembly 38, air is drawn past motor 20, and out of clean air outlet 14.

In other embodiments, cleaning unit 16 may be otherwise configured. For example, cleaning unit 16 may not comprise a filter assembly, or may comprise a plurality of filter assemblies. Additionally, cleaning unit 16 may comprise additional cleaning stages, which may be positioned laterally adjacent each other or above each other.

Figure 10:
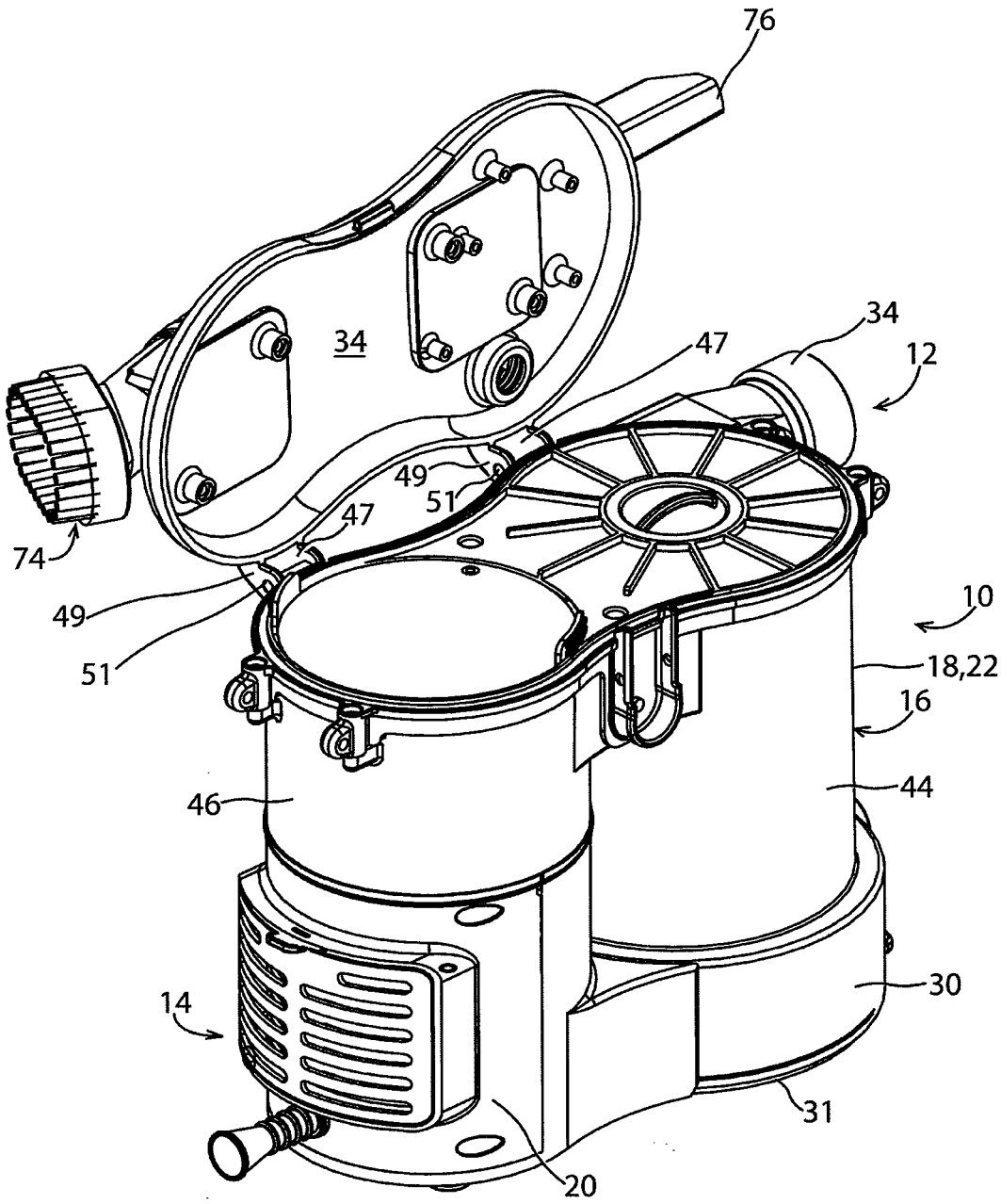
FIG. 10 is a perspective illustration of an alternate embodiment of a surface cleaning apparatus of the present invention, showing a lid in an open position.

In the embodiments shown, the first 44 and second 46 housing are integrally molded. In other embodiments, the first 44 and second 46 housings may be separately manufactured and then secured together, such as by a common base or by gluing, welding or mechanically securing the two housings together. In some embodiments, first 44 and/or second 46 housing may be provided with an openable lid 45, a shown in FIG. 10. When a user opens lid 45, the user may have access to components housed in first 44 and/or second housing 46. For example, as shown in FIG. 10, lid 45 may be provided with a plurality of flanges 47, which are mounted on flanges 49 provided on housings 44 and/or 46. Flanges 47 are pivotally connected together by pivot pins 51. Accordingly, lid 45 may be pivoted from the closed position, as shown in FIGS. 1-9, to the opened position, as shown in FIG. 10.

Referring again to FIGS. 1-4, cleaning unit 16 is mounted to a wheeled base 58. Wheeled base 58 comprises a plurality of wheels 60, and a cradle 62, which receives cleaning unit 16.

Figure 5:
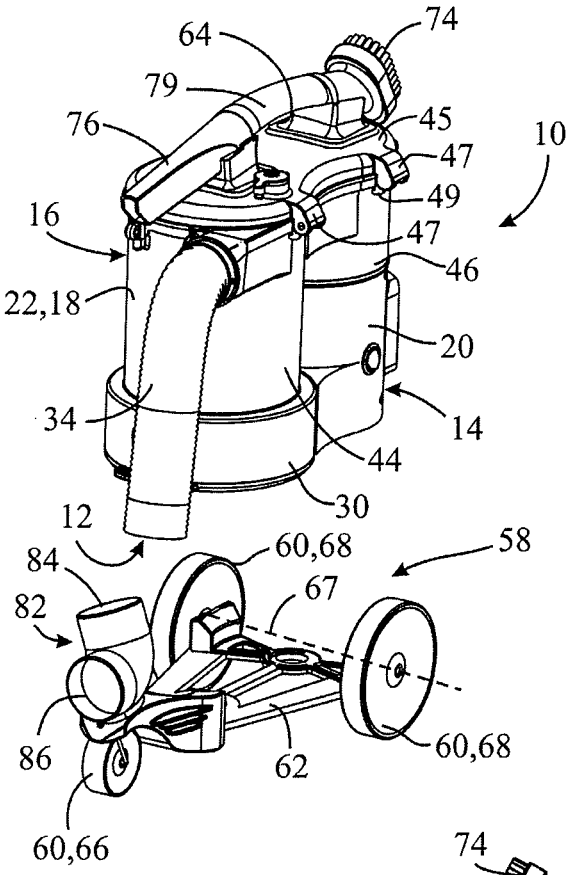
FIG. 5 is a perspective view of the embodiment of FIG. 1, showing a cleaning unit removed from a wheeled base.
Figure 6:
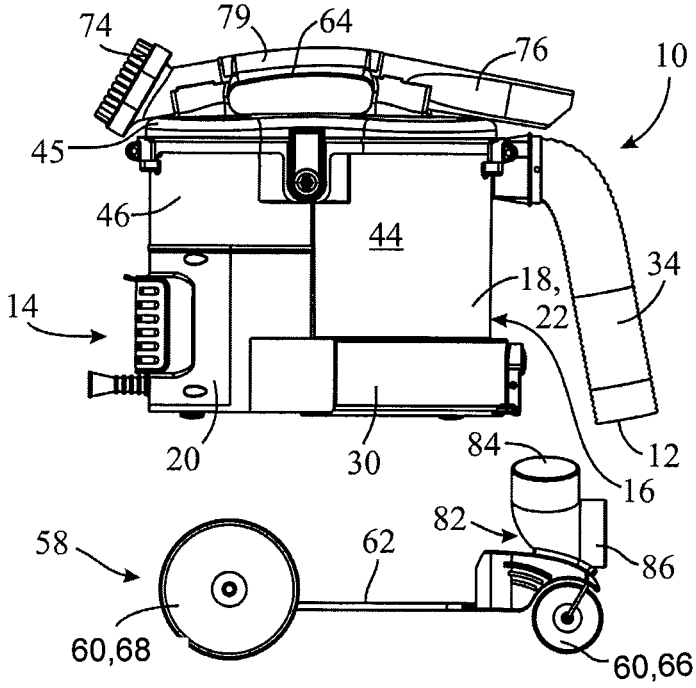
FIG. 6 is a side view of the embodiment of FIG. 1, showing a cleaning unit removed from a wheeled base.

In some embodiments, cleaning unit 16 may be permanently mounted to wheeled base 58, for example via one or more bolts. In other embodiments, cleaning unit 16 may be removably mounted to wheeled base 58. For example, a user may remove cleaning unit 16 from wheeled base in order to maneuver cleaning unit 16, or to empty material collection chamber 30. In such embodiments, cleaning unit 16 is portable. For example, as shown in FIGS. 5 and 6, cleaning unit 16 may be removed from wheeled base 58 by lifting cleaning unit 16 off of wheeled base 58.

In any embodiment, surface cleaning apparatus 10 may comprise a handle 64, and/or a shoulder strap 65 (shown in FIG. 8) for maneuvering cleaning unit 16 when it is removed from wheeled base 58. In some embodiments, handle 64 may be integrally formed with one or both of first 44 and second 46 housings.

Surface cleaning apparatus 10 may further comprise a locking member (not shown), such that cleaning unit 16 may be lockably received on wheeled base 58. The locking member may comprise any suitable locking member known in the art, such as, for example, a quick release latch, a friction or snap fit, a set screw, a tie down strap (e.g., a strap which may be wrapped around cleaning unit 16) or the like. Alternately wheeled base 58 may have side wall extending up around cradle 62 within which portable cleaning unit 16 is received. It will be appreciated that cradle 64 may be any member on which portable cleaning unit 16 may be received or secured, such as a flat base with or without side walls.

In the embodiments exemplified, wheeled base 58 comprises a front wheel 66, and two rear wheels 68*a*, 68*b*. Accordingly, cradle 62 is a platform that is generally polygonal and, preferably, generally triangular in configuration. This configuration may provide increased maneuverability to surface cleaning apparatus 10. In other embodiments, wheeled base 58 may comprise another number of wheels. For example, in some embodiments, wheeled base 58 may comprise two front wheels and two rear wheels. It will be appreciated that, as exemplified, housings 44, 46 may be oriented on cradle 62 with the suction motor at the rearward end of portable cleaning unit 16 and the inlet to portable cleaning unit 16 at the forward end of the front housing, In alternate configurations, housings 44, 46 may be positioned side by side. Further, if more than two housings 44, 46 are provided, then the housings may be arranged linearly, in a triangular configuration or any other desired configuration.

In some embodiments, front wheel 66 is rotatably mounted about a vertical axis to cradle 62 (e.g., is a caster wheel), and rear wheels are non-rotatably mounted about a vertical axis. Accordingly, front wheel 66 may be steerable. In other embodiments, all of front wheel 66 and rear wheels 68 may be caster wheels, or may be non-rotatably mounted wheels.

In some embodiments, wheeled base 58 has a length greater than its width. That is, the distance L between front wheel 66 and axis 67 extending between rear wheels 68*a*, 68*b*, is greater than the distance W between rear wheels 68*a*, 68*b*, along axis 67. In other embodiments, wheeled base 58 may have a width W greater than its length L, or may have width W equal to its length L.

In the embodiments shown, front wheel 66 is of a smaller diameter than rear wheels 68*a*, 68*b*. Alternately, rear wheels 68*a*, 68*b* may be smaller then front wheel 66. Preferably, both the front and rear wheels are each relatively large. For example, in some embodiments, front wheel(s) may have a diameter of between about 0.5-4 inches, preferably 1-3 inches and more preferably 1.5-2.5 inches. In some embodiments, rear wheels may have a diameter of between about 0.5-4 inches, preferably 1-3 inches and more preferably 1.5-2.5 inches. In one particular embodiment, both front wheel(s) 66 and rear wheels 68*a*, 68*b* have a diameter in the same range. Such embodiments may be advantageous to provide surface cleaning apparatus 10 with increased maneuverability and with increased stability.

In the embodiments shown, wheeled base 58 is configured such that, when cleaning unit 16 is mounted on cradle 62, rear wheels 58 are positioned outwardly of cleaning unit 16. That is, rear wheels 58 are separated by a distance W that is greater than the width W' of cleaning unit 16. Such embodiments may provide surface cleaning apparatus 10 with a wider stance, and accordingly with increased stability. Additionally, because rear wheels 68 are positioned outwardly of cleaning unit 16, rear wheels 68 may be provided with an increased diameter, as previously mentioned, without increasing the distance between cleaning unit 16 and a surface such as a floor. Accordingly, the centre of mass of cleaning unit 16 may remain low, which further increases the stability of surface cleaning apparatus 10.

In some embodiments, wheeled base 58 may comprise operating components of surface cleaning apparatus 10. For example, wheeled base may comprise a portion that is provided in the fluid flow path, and includes a filter assembly (not shown). In other embodiments, as exemplified and as s preferred, wheeled base 58 may not comprise any operating components (i.e. wheeled base has an absence of operating components).

In the embodiments shown, cleaning unit 16 is oriented such that dirty fluid inlet 12 is provided at a front end 70 of surface cleaning apparatus 10, adjacent front wheel 66, and suction motor 20 is provided at a rear end 72 of surface cleaning apparatus 10, adjacent rear wheels 68. In other embodiments, cleaning unit 16 may be otherwise oriented. For example, suction motor 20 may be provided at front end 70, and dirty fluid inlet 12 may be provided at rear end 72. Alternatively, cleaning unit 16 may be oriented such that suction motor 20 and dirty fluid inlet 12 are equally spaced from front wheel 66 and rear wheels 68. That is, cleaning unit 16 may be positioned substantially sideways in wheeled base 58.

In some embodiments, wheeled base 62 may comprise a floor cleaning mount 82 coupled to cradle 62. A first end 84 of mount 82 is configured for receiving member 34, which, in the embodiments exemplified in FIGS. 1-6, is a hose. A second end 86 of mount 82 is configured for receiving another member, for example a surface cleaning head that is preferably at the distal end of a wand and a flexible hose extends between the wand and mount 82 (not shown). It will be appreciated that portable cleaning unit 16 may be designed such that the inlet of the portable cleaning unit automatically is connected in flow communication with mount 82 when portable cleaning unit 16 is positioned on wheeled base 58, such as by use of an inlet port aligned with first end 84 or a rigid pipe that is fittable thereon. Alternately, as exemplified, a flexible hose 34 that is manually insertable may be used. An advantage of this design is that the attachment member for a wand or the like is provided on the platform and not the portable cleaning unit. Therefore, the wand may be used to pull wheeled base 58 without risk of pulling portable cleaning unit 16 off of wheeled base 58. Further, preferably the attachment point is close to the floor, preferably at the level of cradle 62, thereby lowering the point at which wheeled base 58 may be pulled and increasing the stability of wheeled base 58 when it is being pulled.

It will be appreciated that in the portable mode, a wand or flexible hose and wand, or other member known in the art may be attached to hose 34 or hose 34 may be removed and the wand or flexible hose and wand, or other member known in the art may be attached directly to the inlet to housing 44.

In some embodiments, one or more accessories, such as cleaning brush 74 and wand extension 76 may be secured to the upper surface of lid 45, such as by means of mounts 78. Accordingly, extension 76 may be configured to function as a handle (e.g. central section 76 may be arcuate in shape or be spaced from lid 45), to define an opening 80 between the upper surface of lid 34 such that extension 76 of brush 74 may be a carry handle 64 for the vacuum cleaner. Alternately, extension 76 may be configured to seat on handle 64 and permit handle 64 to be used when brush 74 is mounted on portable cleaning unit 16.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

The invention claimed is:

1. A canister style surface cleaning apparatus having a bottom and comprising:

(a) a wheeled based having a front end and a cleaning mount having an upstream end;

(b) a first flexible hose having an upstream end that is exterior of the wheeled base and a downstream end that is removably connectable to the upstream end of the cleaning mount:

(c) a portable cleaning unit removably mounted on the wheeled base and comprising a suction motor, at least one cyclonic separation stage having an associated material collection chamber which is sealed when the portable cleaning unit is removed from the wheeled base and a second flexible hose that is removable with the portable cleaning unit from the wheeled base; and, (d) a fluid flow path extending from the cleaning mount to a clean air exit of the surface cleaning apparatus.

2. The canister style surface cleaning apparatus of claim 1 wherein the second flexible hose forms part of the fluid flow path when the portable cleaning unit is mounted on the wheeled base.

3. The canister style surface cleaning apparatus of claim 1 wherein the second flexible hose forms is connectable to a downstream end of the cleaning mount when the portable cleaning unit is mounted on the wheeled base and the first flexible hose is connectable to the upstream end of the cleaning mount.

4. The canister style surface cleaning apparatus of claim 1 wherein the material collection chamber is removable from the at least one cyclone chamber.

5. The canister style surface cleaning apparatus of claim 1 wherein the material collection chamber has a portion that is openable.

6. The surface cleaning apparatus of claim 5 wherein the portion that is openable is a bottom wall.

7. The canister style surface cleaning apparatus of claim 1 wherein the wheeled base has at least one front wheel and at least two rear wheels, the rear wheels have a larger diameter than the at least one front wheel and the at least one front wheel is steerable.

8. The canister style surface cleaning apparatus of claim 1 wherein the wheeled base has at least one front wheel and at least two rear wheels and the rear wheels have a larger diameter than the at least one front wheel.

9. The canister style surface cleaning apparatus of claim 1 wherein the cleaning unit is lockably receivable on the wheeled base.

10. The canister style surface cleaning apparatus of claim 1 wherein the cleaning unit has a shoulder strap.

11. The canister style surface cleaning apparatus of claim 1 wherein the shoulder strap is connected to a cyclone housing and a pre-motor filter housing of the portable cleaning unit.

12. The canister style surface cleaning apparatus of claim 1 wherein the wheeled base has an absence of an upper section pivotally mounted to the wheeled base.

13. A canister style surface cleaning apparatus having a bottom and comprising:

(a) a wheeled based having a front end and a cleaning mount, the cleaning mount adapted to receive a surface cleaning attachment that comprises a first flexible hose;

(b) a portable cleaning unit removably mounted on the wheeled base and comprising a suction motor and at least one cyclonic separation stage having an associated material collection chamber which is sealed when the portable cleaning unit is removed from the wheeled base; and (c) a fluid flow path extending from the cleaning mount to a clean air exit of the surface cleaning apparatus;

wherein the portable cleaning unit has a front end having a portable cleaning unit dirty fluid inlet and the front end of the cleaning unit is positioned at the front end of the wheeled base and the suction motor is positioned rearward of the at least one cyclonic separation stage.

14. A canister style surface cleaning apparatus having bottom and comprising:

(a) a wheeled based having a front end and a cleaning mount, the cleaning mount adapted to receive a surface cleaning attachment that comprises a first flexible hose the wheeled base further comprising at least one front wheel and at least two rear wheels, the rear wheels have a smaller diameter than the at least one front wheel and the at least one front wheel is steerable;

(b) a portable cleaning unit removably mounted on the wheeled base and comprising a suction motor and at least one cyclonic separation stage having an associated material collection chamber which is sealed when the portable cleaning unit is removed from the wheeled base; and, (c) a fluid flow path extending from the cleaning mount to a clean air exit of the surface cleaning apparatus.

15. A canister style surface cleaning apparatus having a bottom and comprising:

(a) a wheeled based having a front end and a cleaning mount, the cleaning mount adapted to receive a surface cleaning attachment that comprises a first flexible hose wherein the wheeled base further comprises has at least one front wheel and at least two rear wheels and the rear wheels have a smaller diameter than the at least one front wheel;

(b) a portable cleaning unit removably mounted on the wheeled base and comprising a suction motor and at least one cyclonic separation stage having an associated material collection chamber which is sealed when the portable cleaning unit is removed from the wheeled base; and, (c) a fluid flow path extending from the cleaning mount to a clean air exit of the surface cleaning apparatus.

* * * * *

UNITED STATES PATENT AND TRADEMARK OFFICE

CERTIFICATE OF CORRECTION

PATENT NO. : 8,752,239 B2
APPLICATION NO. : 13/720754
DATED : June 17, 2014
INVENTOR(S) : Wayne Ernest Conrad It is certified that error appears in the above-identified patent and that said Letters Patent is hereby corrected as shown below:

In the Claims:

1. Column 9, line 14, "A canister style surface cleaning apparatus having bottom and comprising:" should read -- A canister style surface cleaning apparatus having a bottom and comprising: --.

Signed and Sealed this
Thirtieth Day of September, 2014

Michelle K. Lee

Michelle K. Lee
*Deputy Director of the United States Patent and Trademark Office*